US008794307B2

(12) United States Patent
Coquilleau et al.

(10) Patent No.: US 8,794,307 B2
(45) Date of Patent: Aug. 5, 2014

(54) WELLSITE SURFACE EQUIPMENT SYSTEMS

(75) Inventors: Laurent Coquilleau, Houston, TX (US); Edward Leugemors, Sugar Land, TX (US); William Marshall, Richmond, TX (US); Rod Shampine, Houston, TX (US); Philippe Gambier, Houston, TX (US); Hubertus V. Thomeer, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 406 days.

(21) Appl. No.: 12/563,209

(22) Filed: Sep. 21, 2009

(65) Prior Publication Data

US 2010/0071899 A1 Mar. 25, 2010

Related U.S. Application Data

(60) Provisional application No. 61/098,896, filed on Sep. 22, 2008.

(51) Int. Cl.
*E21B 19/00* (2006.01)

(52) U.S. Cl.
USPC ..... 166/75.15; 166/75.11; 166/305.1

(58) Field of Classification Search
None
See application file for complete search history.

(56) References Cited

U.S. PATENT DOCUMENTS

| | | | | |
|---|---|---|---|---|
| 1,330,207 | A * | 2/1920 | Marsh | 123/41.31 |
| 2,336,683 | A | 12/1943 | Hatfield | |
| 2,823,752 | A | 2/1958 | Walter | |
| 2,923,357 | A | 2/1960 | Daffin | |
| 3,334,690 | A | 8/1967 | Garrett | |
| 3,522,995 | A | 8/1970 | Erickson | |
| 3,548,938 | A | 12/1970 | Parker | |
| 3,833,060 | A | 9/1974 | Craggs et al. | |
| 3,873,238 | A | 3/1975 | Elfarr | |
| 3,889,748 | A | 6/1975 | Tausch | |
| 3,894,583 | A | 7/1975 | Morgan | |
| 3,894,814 | A | 7/1975 | Morgan | |
| 3,941,510 | A | 3/1976 | Morgan | |
| 4,007,786 | A * | 2/1977 | Schlinger | 166/266 |
| 4,239,082 | A | 12/1980 | Terral | |
| 4,344,485 | A | 8/1982 | Butler | |
| 4,390,061 | A | 6/1983 | Short | |
| 6,016,868 | A | 1/2000 | Gregoli et al. | |

(Continued)

FOREIGN PATENT DOCUMENTS

| | | | |
|---|---|---|---|
| RU | 2381349 | * 2/2010 | E21B 43/01 |
| WO | WO03098104 | 11/2003 | |

OTHER PUBLICATIONS

Translation of RU 2381349, retrieved from http://www.microsoft-translator.com/BV.aspx?ref=IE8Activity&a=http%3A%2F%2Fwww.findpatent.ru%2Fpatent%2Fpatent%2F238%2F2381349.html, Mar. 27, 2014.*

(Continued)

*Primary Examiner* — Angela M DiTrani

(57) ABSTRACT

A system for powering wellsite surface equipment comprises at least one prime mover in communication with a fuel source for powering the prime mover and having at least one heat source, at least one pump arranged to be driven by the prime mover, the at least one pump in fluid communication with at least one wellbore and at least one fluid for use in the wellbore, and at least one auxiliary system in communication with the heat source from the at least one prime mover.

18 Claims, 3 Drawing Sheets

(56) References Cited

U.S. PATENT DOCUMENTS

| | | | | |
|---|---|---|---|---|
| 6,808,693 | B2 * | 10/2004 | Arnaud et al. | 423/212 |
| 6,910,335 | B2 | 6/2005 | Viteri et al. | |
| 7,055,627 | B2 | 6/2006 | Fontana et al. | |
| 7,219,722 | B2 | 5/2007 | Fincher et al. | |
| 7,395,877 | B2 | 7/2008 | Hosie et al. | |
| 7,400,262 | B2 | 7/2008 | Chemali et al. | |
| 7,445,049 | B2 | 11/2008 | Howard et al. | |
| 2007/0125544 | A1 * | 6/2007 | Robinson et al. | 166/308.3 |
| 2008/0078552 | A1 * | 4/2008 | Donnelly et al. | 166/303 |
| 2009/0008096 | A1 * | 1/2009 | Schultz et al. | 166/303 |

OTHER PUBLICATIONS

Office Action and Search Report issued Mar. 29, 2013 for Chinese Patent Application No. 200910253050.X, 10 pages.

Official Action, and agent's translation thereof, dated Jul. 8, 2013, and foreign reference cited RU 2381349 C1, for Russian Patent Application No. 2009135320, 18 pages.

Official Action, and agent's translation thereof, dated Jun. 12, 2012 for Mexican Patent Application No. MX/a/2009/010141, 8 pages.

* cited by examiner

WELLSITE SURFACE EQUIPMENT SYSTEMS

CROSS-REFERENCE TO RELATED APPLICATION

This application is entitled to the benefit of, and claims priority to, provisional patent application No. 61/098,896 filed Sep. 22, 2008, the entire disclosure of which is incorporated herein by reference.

BACKGROUND

The statements in this section merely provide background information related to the present disclosure and may not constitute prior art. The invention is related in general to wellsite surface equipment such as fracturing equipment and the like.

Typical well servicing systems comprise a prime mover powered by an energy source such as a diesel engine or the like that drives at least one driven component such as a pump, which is in fluid communication with the wellbore for introducing fluids into the wellbore. Fluids may comprise fracturing fluids, proppant(s), acid(s), cement slurries, gravel pack mixtures, drilling fluids, completion fluids, compressed gases, and combinations thereof.

It remains desirable to provide improvements in wellsite surface equipment in efficiency, flexibility, and capability.

SUMMARY

A system for powering wellsite surface equipment comprises at least one prime mover in communication with a fuel source for powering the prime mover and having at least one heat source, at least one pump arranged to be driven by the prime mover, the at least one pump in fluid communication with at least one wellbore and at least one fluid for use in the wellbore, and at least one auxiliary system in communication with the heat source from the at least one prime mover. The fuel source may comprise a combustible gas fuel source. The combustible gas fuel source may comprise one of natural gas supplied directly from the wellbore, natural gas supplied by a producing well, natural gas supplied from a production facility, and combinations thereof. The combustible gas fuel source may comprise one of compressed natural gas (CNG), liquefied natural gas (LNG), natural gas from a pipeline or storage field, a compressed combustible gas such as hydrogen or propane, a liquefied hydrocarbon gases such as butane, and combinations thereof.

The fuel source may comprise a liquid fuel. The prime mover may comprise at least one of a compression ignition reciprocating engine, a spark ignition reciprocating engine, a fuel cell, and a turbine engine. The at least one pump may comprise one of a positive displacement plunger pump, a centrifugal pump, a progressing cavity pump, and combinations thereof. The heat source may comprise at least one an exhaust gas outlet, a prime mover cooling system, an auxiliary cooling system, and combinations thereof.

The auxiliary system may comprise an auxiliary heat exchanger in communication with the at least one heat source. The auxiliary system may comprise one of a steam generator, an evaporator for a working fluid, a heat source to heat at least one of the fluid for use in the wellbore, the fuel source, and a fluid produced from the wellbore. The auxiliary system may comprise a waste heat driven refrigeration system.

The system may further comprise noise reduction system. The system may further comprise an air inlet for supplying the prime mover with a source of air, the air inlet comprising an air heat exchanger for cooling or heating the source of air. The air heat exchanger may be in fluid communication with the auxiliary system. The fluid for use in the wellbore may comprise at least one of a fracturing fluid comprising at least one of a fluid and a proppant, an acid, a cement slurry, a gravel pack mixture, a drilling fluid, a completion fluid, a compressed gas, and combinations thereof. The auxiliary system may comprise a heat exchanger in communication with the natural gas fuel source for extracting heat from the fuel source as it expands.

In an embodiment, a method, comprises providing a system for powering wellsite equipment, the system comprising at least one prime mover in communication with a fuel source for powering the prime mover and having at least one heat source, at least one pump arranged to be driven by the prime mover, the at least one pump in fluid communication with at least one wellbore and at least one fluid for use in the wellbore, and at least one auxiliary system in communication with the heat source from the at least one prime mover, positioning the wellsite equipment and system adjacent the wellbore, and performing at least one well services operation in the wellbore with the wellsite equipment.

The well services operation may comprise one of a fracturing operation, an acid treatment operation, a cementing operation, a well completion operation, a sand control operation, a coiled tubing operation, and combinations thereof. The fuel source may comprise a combustible gas fuel source. The combustible gas fuel source may comprise one of natural gas supplied directly from the wellbore, natural gas supplied by a producing well, natural gas supplied from a production facility, and combinations thereof. The combustible gas fuel source may comprise one of compressed natural gas (CNG), liquefied natural gas (LNG), natural gas from a pipeline or storage field, a compressed combustible gas, a liquefied hydrocarbon gas, and combinations thereof. The heat source may comprise at least one of an exhaust gas outlet, a prime mover cooling system, an auxiliary cooling system, and combinations thereof.

BRIEF DESCRIPTION OF THE DRAWINGS

These and other features and advantages of the present invention will be better understood by reference to the following detailed description when considered in conjunction with the accompanying drawings wherein.

DETAILED DESCRIPTION

Figure 1:
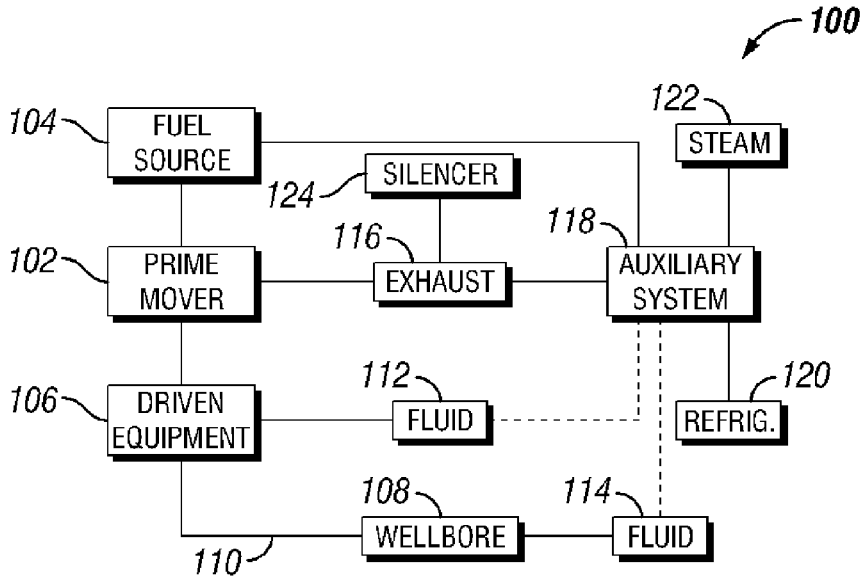
FIG. 1 is a schematic block diagram of an embodiment of a wellsite surface equipment system.

Referring now to all of the Figures, an embodiment of a wellsite surface system is indicated generally at 100. The system 100 may be utilized for powering wellsite surface equipment comprising a prime mover 102 that is in communication with a fuel source 104 and is arranged to drive or power driven equipment or components 106, such as at least one pump or the like. The at least one pump 106 may be in fluid communication with a wellbore 108 via suitable piping and/or plumbing conduits 110 including, but not limited to, those conduits known in the art as treating iron. The pump 106 may further be in fluid communication with more than one wellbore 108 and at least one fluid 112 for use in the at least one wellbore 108. The pump 106 may be in fluid communication with more than one fluid 112. The system 100 may be mounted on a skid or trailer (not shown) for moving the system 100 to various wellbores, such as the wellbore 108. The prime mover 104 may comprise a heat source such as an exhaust gas outlet 116 or other suitable heat source in communication with at least one auxiliary system 118, which may further comprise a heat exchanger or the like, discussed in more detail below.

The pump 106 may supply fluid 112 to the wellbore 108 and a fluid 114 may be supplied from the wellbore 108 during operation of the system 100, such as, but not limited to, produced water and/or produced liquid or the like. The produced liquid, water, or fluid 114 may further be supplied to the pump 106, as will be appreciated by those skilled in the art.

The prime mover 102 may be an internal combustion engine, such as a compression-ignition or diesel reciprocating engine, a spark-ignition reciprocating engine, a turbine engine such as an aeroderivative turbine engine, an industrial turbine engine, a scramjet engine, a fuel cell, or the like, as will be appreciated by those skilled in the art.

Figure 4:
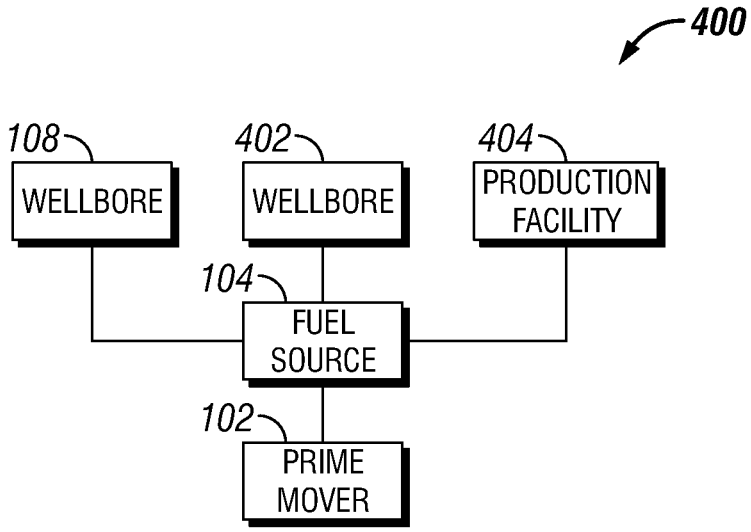
FIG. 4 is a schematic block diagram of an embodiment of a fuel source for wellsite surface equipment system.
Figure 5:
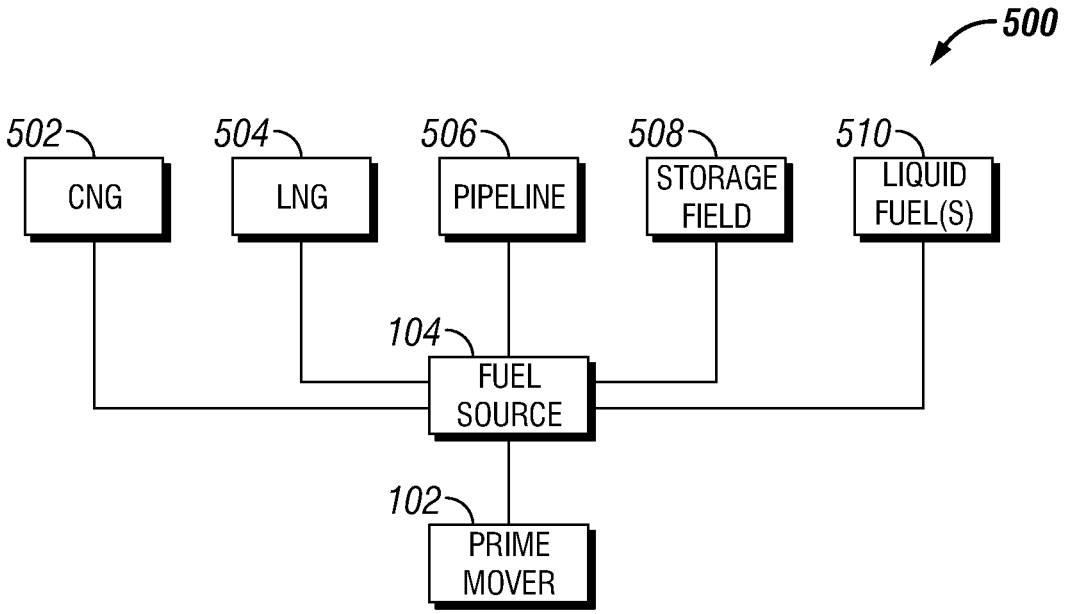
FIG. 5 is a schematic block diagram of an embodiment of a fuel source for wellsite surface equipment system.

Referring to FIGS. 4 and 5, there is shown embodiments of fuel sources, indicated generally at 400 and 500. The fuel source 104 may be a combustible gas source such as compressed natural gas (CNG) 502, liquefied natural gas (LNG) 504, and/or natural gas from a pipeline 506 or a storage field 508. The fuel source 104 may comprise combustible gas, such as natural gas or the like, supplied directly from the wellbore 108, a producing wellbore 402, such as an adjacent producing wellbore, a production facility 404, or any combination of the natural gas sources 108, 402, 404, 502, 504, 506, and 508 shown in FIGS. 4 and 5. The fuel source 104 may comprise a compressed combustible and/or flammable gas such as hydrogen or propane or a liquefied combustible and/or flammable hydrocarbon gas such as butane from the wellbore 108, the producing wellbore 402, or the production facility 404. The fuel source 104 may comprise a liquid fuel source 510, such as diesel fuel, kerosene, or the like. The fuel source 104 may comprise a combination of the above-mentioned natural gas sources 108, 402, 404, 502, 504, 506, and 508 and the above-mentioned liquid fuel sources 510, as will be appreciated by those skilled in the art.

The fuel source 104 may be selected to reduce and/or alter the overall emissions profile of the exhaust gas in the exhaust gas system 116, such as by reducing total particulate matter, total NOx emissions, the amount of carbon monoxide or carbon dioxide contained in the exhaust gas or the like. As the prime mover 104 is operated, exhaust gas is generated and routed through the exhaust system 116. The heat of the exhaust gas in the exhaust system 116 may then be utilized in at least one auxiliary system 118, discussed in more detail below.

The pump 106 may comprise a positive displacement pump such as a plunger pump (such as a triplex or quintuplex plunger pump), a centrifugal pump, a progressing cavity pump, or any suitable equipment and combinations thereof for providing the fluid 112 to the wellbore 108 such as under pressure or the like, as will be appreciated by those skilled in the art.

Figure 2:
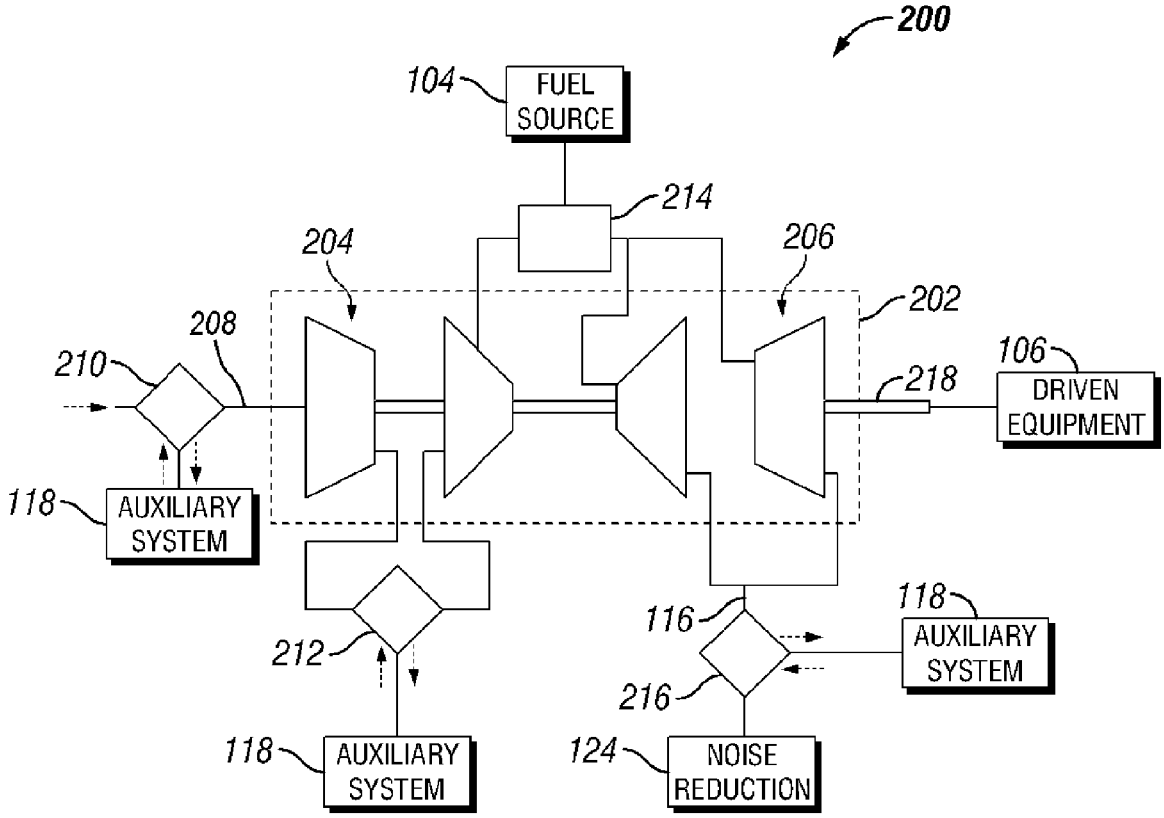
FIG. 2 is a schematic block diagram of an embodiment of a wellsite surface equipment system.

In an embodiment, best seen in FIG. 2, a system is indicated generally at 200. The system 200 comprises a prime mover 202 that is a turbine engine having a compressor section 204 and a turbine or turbo expander section 206. Air is introduced to the prime mover 202 at an inlet 208 and may be routed through an air heat exchanger 210. The air heat exchanger 210 may be utilized to cool the incoming air into the prime mover 202. The air is directed from the heat exchanger to the compression section 204 of the prime mover or turbine engine 202. The compression section 202 may have a plurality of compression stages and the air may be routed through at least one intercooler 212 between or after one or more of the compression stages. The compressed air exits the compression section 204, is mixed with fuel from the fuel source 104, is ignited with an ignitor (not shown) or the like in a combustor 214, and routed through the turbine or expander section 206 of the engine 202. The turbine or expander section 206 may include a plurality of expansion stages and exhaust gas may be routed from the final stage or an intermediate stage in an exhaust gas outlet to an auxiliary heat exchanger 216 for use with an auxiliary system, such as the auxiliary system 118. An output 218, such as a shaft, of the prime mover 202 is connected to an input (not shown), such as a shaft, of the driven device or devices, such as the pump 106 or the like, by a direct or closed coupled connection, a transmission, a gear reducer, a power turbine close coupled to the pump or by any suitable connection.

As noted above, the pump 106 or driven device is in fluid communication with both the wellbore 108 and the source of a fluid 112, such as a working or treatment fluid, including, but not limited to, a fracturing fluids, proppant(s), acid(s), cement slurries, gravel pack mixtures, drilling fluids, completion fluids, and combinations thereof.

The auxiliary system 118 may utilize the auxiliary heat exchanger 216 as a steam generator 122 for generating steam and operating a combined cycle system, such as by operating a steam turbine with a suitable output or the like, as will be appreciated by those skilled in the art. The auxiliary system 118 may utilize the auxiliary heat exchanger 216 as an evaporator for a working fluid, such as the fluid 112, the fluid 114, the fuel source 104, or the like.

The auxiliary system 118 may utilize the auxiliary heat exchanger 216 as a heat source to heat the fluid 112 to, for example, control the chemical reactions and/or characteristics of the fluid or treatment fluid 112. The heated treatment fluid 112 may be routed to the wellbore by a suitable pumping and/or plumbing arrangement, such as the pump 106 and treating iron 110.

The auxiliary system 118 may utilize the auxiliary heat exchanger 216 as a heat source to heat the fluid 114, such as produced fluid from the wellbore 108 or an adjacent wellbore or facilities. The produced fluid 114 may be conditioned or otherwise treated prior to being evaporated or boiled off as part of the auxiliary system 118 or the conditioned or treated fluid 114 may be injected into the turbine or expander section 206 of the prime mover 202 or injected into the air inlet 208 of the prime mover 202 to provide cooling.

The auxiliary system 118 may utilize the auxiliary heat exchanger 216 to heat the supercooled gas from the LNG fuel source 504 or the CNG fuel source 502 prior to injection into the prime mover 102, as will be appreciated by those skilled in the art. The auxiliary system 118 may utilize the auxiliary heat exchanger 216 as the heat input of a waste heat driven refrigeration system 120, which may then be utilized to, for example, cool the incoming air in the air heat exchanger 210, such as at the inlet 208 of the prime mover 202, to operate a mechanical chiller system or the like to cool various components of the system 100.

Figure 3:
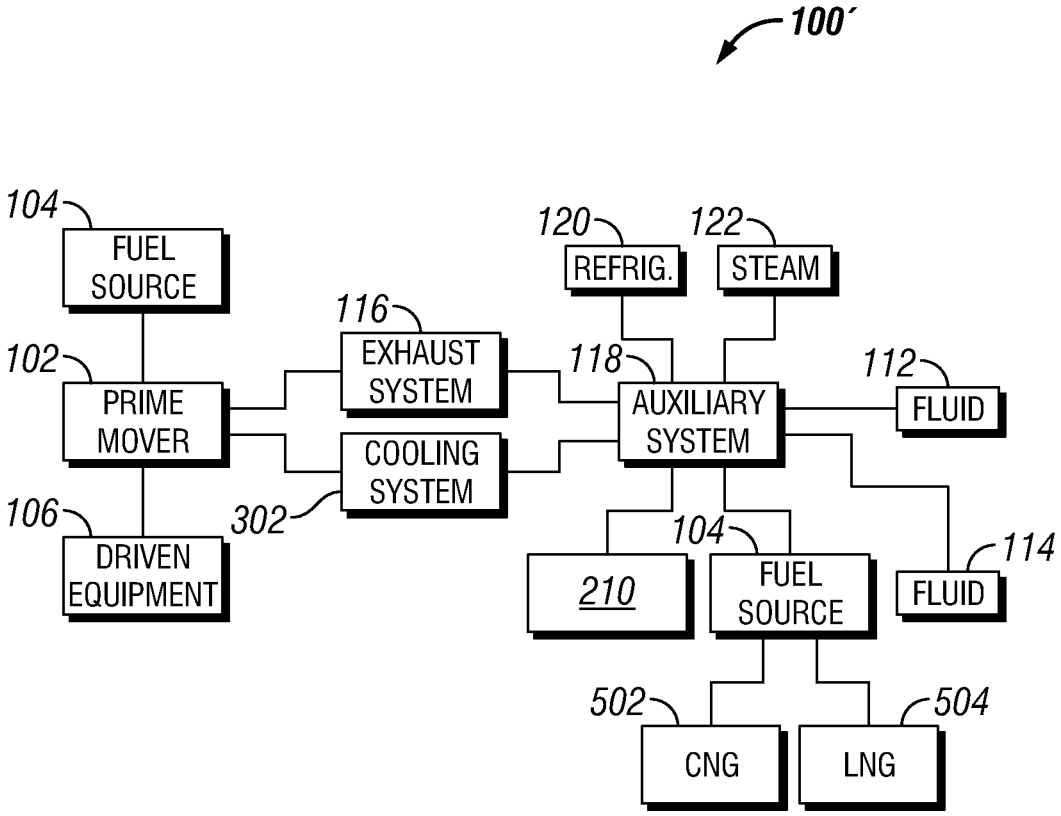
FIG. 3 is a schematic block diagram of an embodiment of a wellsite surface equipment system.

In an embodiment of a system 100' shown in FIG. 3, the auxiliary system 118 may further utilize cooling water from a cooling water system 302 of the prime mover 102 or 202 as a heat source for the auxiliary heat exchanger 216 for use with the fluid 112, the fluid 114, the fuel source 104 (such as the LNG fuel source 504 or the CNG fuel source 502), the refrigeration system 120, the steam generator 122, and the air heat exchanger 210. The system 100' may utilize only cooling water from the cooling water system 302 as a heat source for the auxiliary heat exchanger 216. The systems 100 and 100' may utilize heat from an auxiliary cooling system, the cooling water system 302, the exhaust gas system 116, and combinations thereof, as will be appreciated by those skilled in the art.

The air heat exchanger 210 may be utilized to cool and/or heat the incoming air at the inlet 208 and heat the supercooled natural gas from, for example, the CNG fuel source 502 or the LNG fuel source 504 prior to injection into the prime mover 102 or 202. The natural gas from the air heat exchanger 210 may then be routed to the auxiliary heat exchanger 216 to heat the gas from the air heat exchanger 208 outlet prior to injection, such as at the combustor 214 into the prime mover 202 or 102.

The fluids 114 may comprise fracturing fluids, proppant(s), acid(s), cement slurries, gravel pack mixtures, drilling fluids, completion fluids, and combinations thereof, as will be appreciated by those skilled in the art. The fluid or fluids 114 may be utilized in any number of well servicing operations including, but not limited to, a fracturing operation, an acid treatment operation, a cementing operation, a well completion operation, a coiled tubing operation, a sand control operation, and combinations thereof.

The pump or driven equipment 106 may comprise a pair of pumps arranged to be driven by a single prime mover 102 or 202, such as those disclosed in commonly assigned and copending US Publication No. 2009/0068031, filed Sep. 3, 2008 and incorporated by reference herein in its entirety.

The prime mover 102 or 202 may further comprise a noise reduction system 124. The noise reduction system 124 may be coupled to or in suitable communication with the exhaust system 116 of the prime mover 102 or 202 and may comprise a diversion for the exhaust gas downstream of the auxiliary heat exchanger 216 such that the exhaust gas is directed upwardly. The noise reduction system 124 may comprise a "noise canceling" or counteracting wave directed at a noise source, such as the exhaust gas of the prime mover 102 or 202 to reduce the effective noise of the prime mover 102 or 202 or other surface equipment noise sources and thus reduce the total overall noise of the entire system 100. The auxiliary heat exchanger 216 itself may function as a silencer or noise reducer by routing the exhaust gas through baffles and the like.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. In particular, every range of values (of the form, "from about a to about b," or, equivalently, "from approximately a to b," or, equivalently, "from approximately a-b") disclosed herein is to be understood as referring to the power set (the set of all subsets) of the respective range of values. Accordingly, the protection sought herein is as set forth in the claims below.

The preceding description has been presented with reference to presently preferred embodiments of the invention. Persons skilled in the art and technology to which this invention pertains will appreciate that alterations and changes in the described structures and methods of operation can be practiced without meaningfully departing from the principle, and scope of this invention. Accordingly, the foregoing description should not be read as pertaining only to the precise structures described and shown in the accompanying drawings, but rather should be read as consistent with and as support for the following claims, which are to have their fullest and fairest scope.

What is claimed is:

1. A system for powering wellsite surface equipment, comprising:

at least one prime mover in communication with a fuel source for powering the prime mover and having at least one heat source, wherein the prime mover is selected from the group consisting of a compression ignition reciprocating engine, a spark ignition reciprocating engine, a fuel cell, and a turbine engine;

at least one pump arranged to be driven by the prime mover, the at least one pump adapted to introduce at least one fluid for use in at least one wellbore and be supplied at least one fluid from the at least one wellbore; and at least one auxiliary system in communication with the heat source of the at least one prime mover, wherein the at least one auxiliary system comprises a heat exchanger configured to transfer heat from the heat source to the at least one fluid from the at least one wellbore, to boil off a portion of the at least one fluid from the at least one wellbore from another portion of the at least one fluid from the at least one wellbore.

2. The system of claim 1 wherein the fuel source is a combustible gas fuel source.

3. The system of claim 2 wherein the combustible gas fuel source is selected from the group consisting of natural gas supplied directly from the wellbore, natural gas supplied by a producing well, natural gas supplied from a production facility, and combinations thereof.

4. The system of claim 2 wherein the combustible gas fuel source is selected from the group consisting of compressed natural gas (CNG), liquefied natural gas (LNG), natural gas from a pipeline or storage field, compressed hydrogen, compressed propane, liquefied butane, and combinations thereof.

5. The system of claim 1 wherein the fuel source comprises a liquid fuel.

6. The system of claim 1 wherein the at least one pump is selected from the group consisting of a positive displacement plunger pump, a centrifugal pump, a progressing cavity pump, and combinations thereof.

7. The system of claim 1 wherein the heat source is selected from the group consisting of an exhaust gas outlet, a prime mover cooling system, an auxiliary cooling system, and combinations thereof.

8. The system of claim 1 wherein the auxiliary system comprises a waste heat driven refrigeration system.

9. The system of claim 1 further comprising a noise reduction system.

10. The system of claim 1 further comprising an air inlet for supplying the prime mover with a source of air, the air inlet comprising an air heat exchanger for cooling or heating the source of air.

11. The system of claim 10 wherein the air heat exchanger is in fluid communication with the auxiliary system.

12. The system of claim 1 wherein the fluid for use in the wellbore is selected from the group consisting of a fracturing fluid comprising at least one of a fluid and a proppant, an acid, a cement slurry, a gravel pack mixture, a drilling fluid, a completion fluid, a compressed gas, and combinations thereof.

13. A method, comprising:

providing a system for powering wellsite equipment, the system comprising at least one prime mover in communication with a fuel source for powering the prime mover and having at least one heat source, at least one pump arranged to be driven by the prime mover, the at least one pump adapted to introduce at least one fluid for use in at least one wellbore and be supplied at least one fluid from the at least one wellbore, and at least one auxiliary system in communication with the heat source of the at least one prime mover;

positioning the wellsite equipment and system adjacent the wellbore; and performing at least one well services operation in the wellbore with the wellsite equipment;

wherein the prime mover is selected from the group consisting of a compression ignition reciprocating engine, a spark ignition reciprocating engine, a fuel cell, and a turbine engine; and wherein the at least one auxiliary system comprises a heat exchanger configured to transfer heat from the heat source to the at least one fluid from the at least one wellbore, to boil off a portion of the at least one fluid from the at least one wellbore from another portion of the at least one fluid from the at least one wellbore.

14. The method of claim 13 wherein the well services operation is selected from the group consisting of a fracturing operation, an acid treatment operation, a cementing operation, a well completion operation, a sand control operation, a coiled tubing operation, and combinations thereof.

15. The method of claim 13 wherein the fuel source comprises a combustible gas fuel source.

16. The method of claim 15 wherein the combustible gas fuel source is selected from the group consisting of natural gas supplied directly from the wellbore, natural gas supplied by a producing well, natural gas supplied from a production facility, and combinations thereof.

17. The method of claim 15 wherein the combustible gas fuel source is selected from the group consisting of compressed natural gas (CNG), liquefied natural gas (LNG), natural gas from a pipeline or storage field, a compressed combustible gas, a liquefied hydrocarbon gas, and combinations thereof.

18. The method of claim 13 wherein the heat source is selected from the group consisting of an exhaust gas outlet, a prime mover cooling system, an auxiliary cooling system, and combinations thereof.

* * * * *